US010214392B2

(12) United States Patent
Hansen et al.

(10) Patent No.: US 10,214,392 B2
(45) Date of Patent: Feb. 26, 2019

(54) AUTOMATED RECEPTOR SYSTEM

(71) Applicant: Siemens Aktiengesellschaft, München (DE)

(72) Inventors: Steen Mattrup Hansen, Svendborg (DK); Jesper Moeller, Brande (DK); Kenneth Helligsoe Svinth, Aarhus C (DK)

(73) Assignee: Siemens Aktiengesellschaft (DE)

( * ) Notice: Subject to any disclaimer, the term of this patent is extended or adjusted under 35 U.S.C. 154(b) by 0 days.

(21) Appl. No.: 15/556,305

(22) PCT Filed: Mar. 18, 2015

(86) PCT No.: PCT/EP2015/055648
§ 371 (c)(1),
(2) Date: Sep. 7, 2017

(87) PCT Pub. No.: WO2016/146184
PCT Pub. Date: Sep. 22, 2016

(65) Prior Publication Data
US 2018/0044141 A1 Feb. 15, 2018

(51) Int. Cl.
*B66C 1/10* (2006.01)
*B66C 1/62* (2006.01)
*B66C 1/34* (2006.01)

(52) U.S. Cl.
CPC ..... *B66C 1/108* (2013.01); *B66C 1/34* (2013.01); *B66C 1/62* (2013.01)

(58) Field of Classification Search
CPC .. B66C 1/108; B66C 1/14; B66C 1/34; B66C 1/42; B66C 1/62; F03D 13/10; F03D 13/40
(Continued)

(56) References Cited

U.S. PATENT DOCUMENTS 3,630,562 A * 12/1971 Metz ..... B64D 1/22 294/82.33
3,964,777 A 6/1976 Lindqvist
(Continued)

FOREIGN PATENT DOCUMENTS

EP 2107032 B1 12/2011
EP 2832677 A1 2/2015
(Continued)

OTHER PUBLICATIONS

International Search Report & Written Opinion for PCT Application No. PCT/EP2015/055648, dated Oct. 8, 2015.

*Primary Examiner* — Dean J Kramer
(74) *Attorney, Agent, or Firm* — Schmeiser, Olsen & Watts LLP

(57) ABSTRACT

Provided is an automated receptor system of a sling-receiving element for gripping a connection device of a sling of a blade gripping device for gripping a rotor blade, in particular a rotor blade of a wind turbine, which automated receptor system includes a receptor for connecting the connection device to the sling-receiving element and a drive system for pivoting the receptor for coupling the connection device to the sling-receiving element and for decoupling the connection device from the sling-receiving element. Further a sling-receiving element and a blade gripping device are described. Furthermore, provided is a method for gripping a connection device of a sling of a blade gripping device for gripping a rotor blade, in particular a rotor blade of a wind turbine.

10 Claims, 14 Drawing Sheets

(58) Field of Classification Search
USPC ..... 294/75, 82.3, 82.31, 82.33
See application file for complete search history.

(56) References Cited

U.S. PATENT DOCUMENTS

| | | | | |
|---|---|---|---|---|
| 5,772,269 | A * | 6/1998 | Henning, Jr. | B66C 1/16 294/67.22 |
| 6,375,242 | B1 * | 4/2002 | Zingerman | B66C 1/36 294/82.3 |
| 8,191,721 | B2 * | 6/2012 | Hansen | B66C 1/108 212/273 |
| 8,550,522 | B2 * | 10/2013 | Echarri Latasa | B66C 1/108 29/889 |
| 9,206,017 | B2 * | 12/2015 | Hansen | B66C 1/18 |
| 9,440,821 | B2 * | 9/2016 | Hansen | B66C 1/42 |
| 2006/0087137 | A1 * | 4/2006 | Mongan | B66C 1/36 294/82.35 |
| 2007/0222243 | A1 * | 9/2007 | Molaug | B66C 1/38 294/82.3 |

FOREIGN PATENT DOCUMENTS

| | | | |
|---|---|---|---|
| JP | 2014118251 | A | 6/2014 |
| WO | WO 2011050999 | A1 | 5/2011 |

* cited by examiner

12.I

12.II

12.III

12.IV

13.I

13.II

13.III

13.IV

AUTOMATED RECEPTOR SYSTEM

CROSS-REFERENCE TO RELATED APPLICATIONS

This application claims priority to PCT Application No. PCT/EP2015/055648, having a filing date of Mar. 18, 2015, the entire contents of which are hereby incorporated by reference.

FIELD OF TECHNOLOGY

The following concerns an automated receptor system of a sling-receiving element for gripping a connection means or device of a sling of a blade gripping device for gripping a rotor blade, in particular a rotor blade of a wind turbine, i.e. a rotor blade of a large size such as of 50 meters length or longer. Such automated receptor system is realized to receive a sling of a blade gripping device to hold on a rotor blade for a transport of the rotor blade to and/or from an assembly site, in particular an assembly site of a wind turbine. The automated receptor system thus serves hold the rotor blade firmly so that it can be transported (i.e. raised) to the nacelle of the wind turbine and/or lowered from the latter. The following also concerns a sling-receiving element, a blade gripping device and further a method for gripping a connection means or device of a sling of a blade gripping device.

BACKGROUND

The assembly of rotor blades on wind turbines and their transport to and from is a time-consuming, relatively dangerous and also costly task. Known blade gripping devices often consist of a lifting frame (also referred to as lifting yoke) and a number of straps which are attached around at least part of the rotor blade for carrying the rotor blade and holding the rotor blade in place. Using such lifting yokes is quite time consuming, particularly manual attaching the straps around the rotor blade and to a hook and dismounting the blades from the lifting yoke. Especially for dismounting the blades you have to lift up a service technician to the assembly height by a basket from which he operates during the disassembly of the rotor blade.

International patent application WO 2011/050999 A1 shows a system for controlling the mounting of a component of a wind turbine to a mounting frame, wherein the component is mountable to the mounting frame by a strap. The system comprises a stable main frame and an automatic strap moving mechanism connected to the main frame. The strap moving mechanism is adapted for moving the strap between an open position for placing a component in the mounting frame and a closed position, in which the strap is wound around the rotor blade by means of a number of beams that temporarily hold an end portion of the strap to lead it from one side of the rotor blade to the other side. For that purpose, the beams are tilted in several tilting directions in order to eventually encompass the rotor blade partially. A camera control system controls the engaging of the strap in an engaging position.

Further, from patent EP 2 107 032 B1 there is known a device for handling containers comprising a pivoting hook and electromagnetic means to attract a ferromagnetic element connected to a support handle.

Such gripping systems are still rather complex to handle.

Patent application EP 2 832 677 A1, which is referred herein, shows a blade gripping device for gripping a rotor blade, in particular a rotor blade of a wind turbine. The blade gripping device shown in the mentioned application comprises a sling and a sling handover mechanism with a sling-conveying element and a sling-receiving element, whereby the preferably automated sling-conveying element is realized to convey a connection means of the sling along a two-dimensional predefined path of travel around a part of the rotor blade, i.e. from an open position of the gripping tool, towards the sling-receiving element, to connect to a receptor of the sling-receiving element, i.e. to establish a closed position of the blade gripping tool in which the sling-receiving element keeps the connection means of the sling within its receipt.

Although the sling handover is done automatically, there is a problem that the receptor itself has to be operated manually, i.e. the connection of the connection means to the receptor of the sling-receiving element still has to be done manually.

SUMMARY

An aspect relates to an alternative solution, preferably an improved solution, of how a fixing element for holding a rotor blade at a blade gripping device can be locked to the blade gripping device. In this context, it is preferred that the improvement lies at least in the fact that it is easier to handle and/or more effective while at the same time maintaining at least the same safety standard as the solution according to the above-referenced state of the art.

According to embodiments of the invention, an automated receptor system of a sling-receiving element for gripping a connection means or device of a sling of a blade gripping device for gripping a rotor blade, in particular a rotor blade of a wind turbine, comprises a receptor for connecting the connection means or device to the sling-receiving element and a drive system for pivoting the receptor for coupling the connection means or device to the sling-receiving element and for decoupling the connection means or device from the sling-receiving element. Hence, also the receptor system is automated.

The drive system is preferably directly mounted on the receptor.

As for the connection means of device, this can for instance be realized as an eye or ring at one end of the sling, namely that end of the sling which is to be connected to the sling-receiving element.

Further, according to embodiments of the invention, a sling-receiving element for gripping a connection means or device of a sling of a blade gripping device for gripping a rotor blade, in particular a rotor blade of a wind turbine comprises the automated receptor system according to embodiments of the invention.

Furthermore, according to embodiments of the invention, a blade gripping device for gripping a rotor blade, in particular a rotor blade of a wind turbine, comprises the sling-receiving element according to embodiments of the invention.

Moreover, a method for gripping a connection means or device of a sling of a blade gripping device for gripping a rotor blade, in particular a rotor blade of a wind turbine, according to embodiments of the invention, comprises the steps of automated pivoting a receptor for coupling the connection means or device to the sling-receiving element and for decoupling the connection means or device from the sling-receiving element.

"Automated pivoting" means or device that pivoting the receptor is not directly done by an operator. However, for example, the pivoting motion may be controlled by an operator remotely positioned, wherein the operator gets some information about the loading status of the receptor and remotely controls a process of loading or releasing a rotor blade. Alternatively, "automated pivoting" may also mean a fully automated control of the automated receptor system. In this variant, loading and releasing of the connection means or device is completely done without an activity of an operator such as a command signal for remote control etc.

Particularly advantageous embodiments and features of the invention are given by the dependent claims, as revealed in the following description. Features of different claim categories may be combined as appropriate to give further embodiments not described herein.

According to a particularly preferred embodiment, the receptor according to embodiments of the invention comprises a hook. A hook is particularly useful as it can engage easily with the connection means or device of the sling, which may for that purpose for instance comprise an eye or a ring which is sized such that the hook fits into it.

Further, it is preferred that the hook of the automated receptor device comprises a boring for receiving an axis of rotation. In other words, the hook comprises for example a circular relief or a circular hole, through which a rotation axis is fed through such that the hook is able to be rotated or pivoted around the rotation axis.

Preferably, the drive system of the automated receptor system according to embodiments of the invention comprises at least one of the following features:

- a motor as an actuator for driving the pivoting motion of the receptor,
- a crank shaft for transmitting the driving power from the motor to the receptor,
- a bearing for rotatable supporting the crank shaft and
- a crank mounted on the crank shaft for transmitting the power from the shaft of the crank shaft to the receptor.

The motor for driving the pivoting motion of the receptor is used as an actuator, wherein the motor is preferably formed as an electric motor. The crank shaft is used to transmit the power by exploiting the effect of leverage force. The bearings on the crank shaft are utilized to minimize the friction loss of the rotation of the crank shaft.

It is further preferred that the automated receptor system according to embodiments of the invention further comprises a detection system for detecting whether the connection means or device is in the correct position when closing the receptor. That means for example a detection arm, which is active, if the connection means or device contacts the detection arm or pushes the detection arm into an active position.

For example, the detection system further comprises a sensor for detection of movement of the detection arm and additionally a spring, for example a gas spring, which exerts a restoring force on the detection arm, if the detection arm is moved by the connection means or device.

The automated receptor system may further comprise a connecting rod for connecting the crank shaft to the receptor, i.e for example a hook, for pivoting the hook from a closed position into an open position and from an open position into a closed position.

It is also preferred that the automated receptor system according to embodiments of the invention comprises a receptor locking system preventing of rotating the receptor in case of high torque involving to the receptor. In other words, the receptor locking system is intended to prevent a damaging of the driving system due to excessive torque. This may be the case, if the connecting means or device is not in the right position in a closed position of the receptor, which may lead to a movement or sliding of the connecting means or device, which causes high torque exerted on the rotating elements of the receptor in particular to the motor and gear.

The receptor locking system of the automated receptor system according to embodiments of the invention may be based on electromagnetic power and mechanical power, wherein, in case the receptor tries to open more, the crank and the receptor clash, which results in locking the receptor from further rotating. In other words, in this embodiment, a further rotation of the receptor is prevented by contact between crank and receptor, wherein the crank is fixed by the electromagnetic force of the motor or a particular electrical brake break.

Additionally, the automated receptor system according to embodiments of the invention may further comprise a sensor system for detecting, if the receptor is open or closed. Hence, there may be a sensor system which indicates the rotating position of the receptor.

For example, the sensor system may comprise a sensor arm attached to the crank shaft and a sensor supported by a sensor mount next to the crank shaft, wherein the sensor detects the distance between the rotating sensor arm and the sensor. For instance, the sensor arm has a shape, which differs depending from the azimuth. Due to the azimuthal change of the shape of the sensor arm, the distance between the sensor arm and the sensor varies with the rotation of the crank shaft. Hence the rotation position of the crank shaft and the receptor may be detected by the sensor.

According to a special variant, the sensor system comprises at least one optical sensor. Such optical sensors are easy to operate and available in great variety. Further, an optical sensor may be connected to a recognition unit to receive optically visible sensing data from it. For example, the optical sensor also comprises a laser sensor or a light sensor. Such sensor in particular makes possible very accurate and precise measurements of rotation position of the receptor.

Furthermore, the sensor system may function together with markers, e.g. with magnetic markers on the sensor arms. In that particular context it is preferred that the sensor arrangement comprises at least one sensor realized to sense a magnetic field, for instance a Hall effect sensor. This magnetism sensor thus can sense the magnetic marker(s) mentioned above. Such sensors can be realized particularly small. They may be shielded from magnetic influence of (adjacent parts of) the blade gripping device in order not to sense erroneously a magnetic influence from the sensor arm which just came from other parts of the blade gripping device itself.

Another possibility of a sensor system is a capacitive sensor, which may, again, interact with a marker of the sensor arm essentially in the corresponding way as a magnetism sensor with a magnetic marker.

According to a particularly preferred embodiment of the automated receptor system according to embodiments of the invention, the sensor system comprises a position computation unit realized to compute a specific position of the sensor arm and/or an orientation of the receptor from sensor data provided by a sensor or a number of sensors of the sensor system. Such position computation unit may be comprised in a recognition unit. It can supply orientations, i.e. rotation positions of the receptor which rotation position or orientation can be matched in order to derive therefrom information about how and where the receptor should be moved and/or rotated in order to match with the position of the connection means or device.

Furthermore, the automated receptor system may comprise a house with bearings as an attachment system, wherein the bearings i.e. the reliefs or borings of the bearings receive the crank shaft and the rotation axis of the receptor.

Additionally, according to embodiments of the invention, a blade gripping device according to embodiments of the invention, further comprises a blade gripping tool comprising:

a sling and a (preferably automatic) sling handover mechanism with a sling-conveying element and a sling-receiving element, whereby the sling-conveying element is realized to convey a connection means or device of the sling along a two-dimensional predefined path of travel around a part of the rotor blade, i.e. from an open position of the gripping tool, towards the sling-receiving element, to connect to a receptor of the sling-receiving element, i.e. to establish a closed position of the blade gripping tool in which the sling-receiving element keeps the connection means or device of the sling within its receptor. Hence, not only the receptor of the blade gripping device, but also the sling handover mechanism, which is used to transport the sling to the receptor, is preferably automatic.

Preferably, the blade gripping tool comprises an automatic sling handover mechanism. Such automatic, i.e. self-driven mechanism comprises a number of actuator means or device or device to allow for the movement of the sling-conveying element and/or of the sling-receiving element. Such actuators may e.g. be electric (i.e. based on an electric motor) and/or hydraulic (which throughout this description includes pneumatic) and/or based on a spring. Other actuators may also be used instead, always depending on the particular circumstances of operation and/or size and/or space within the blade gripping tool and/or within a blade gripping device equipped with the blade gripping tool according to embodiments of the invention.

BRIEF DESCRIPTION

Some of the embodiments will be described in detail, with references to the following figures, wherein like designations denote like members, wherein.

DETAILED DESCRIPTION

Figure 1:
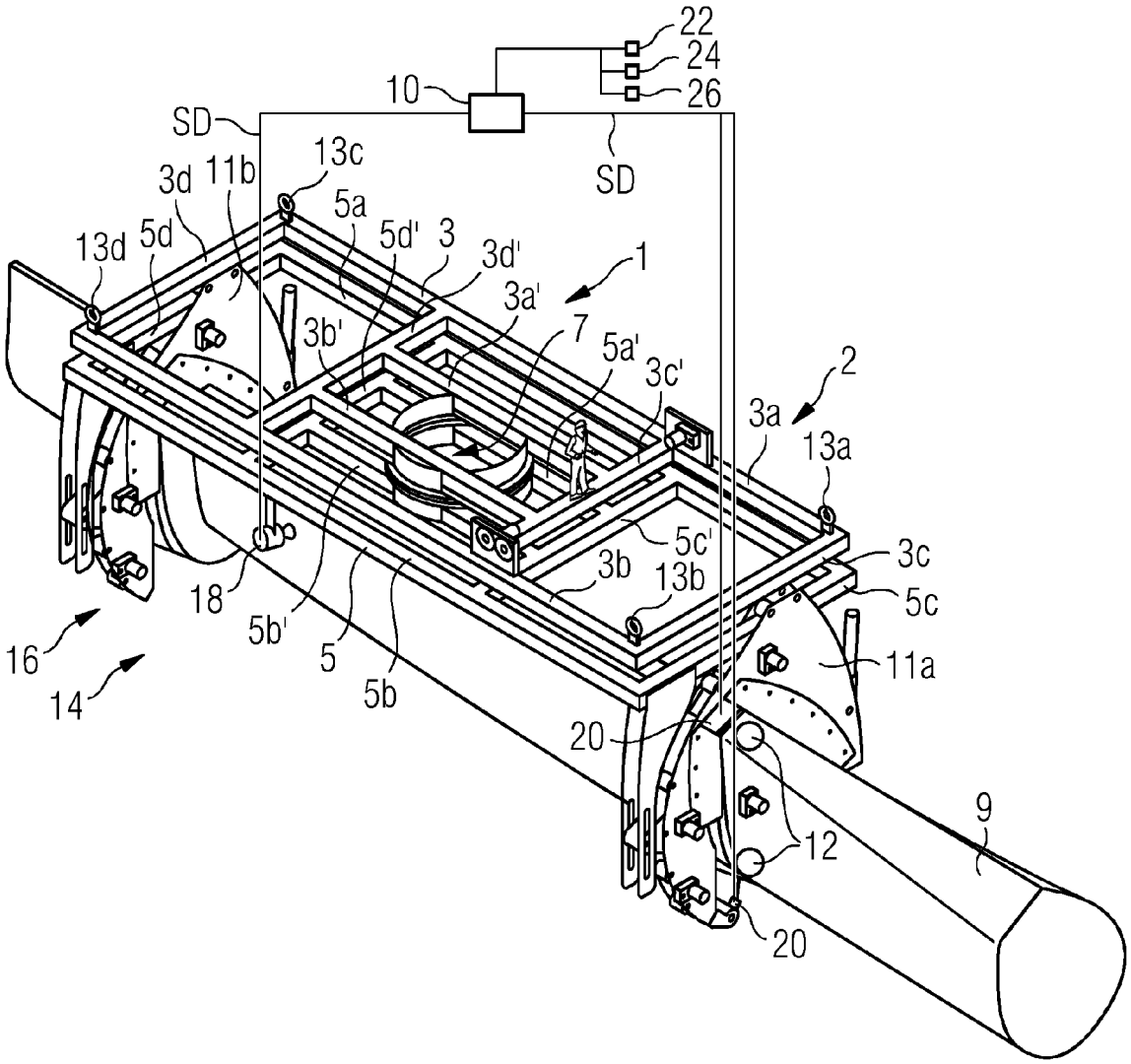
FIG. 1 shows a perspective view of an example of a blade gripping device with a rotor blade.

FIG. 1 shows an example of a blade gripping device 1 according to an embodiment of the invention. It grips a rotor blade 9 of a wind turbine (not shown). The blade gripping device 1 comprises a first frame 3 and a second frame 5 which are interconnected via a swivel connection 7. The first, upper, frame 3 comprises an essentially rectangular, namely oblong shape which is defined by a first outer longitudinal beam 3*a* and a parallel second outer longitudinal beam 3*b* and a first outer cross beam 3*c* and a second outer cross beam 3*d* parallel to the first outer cross beam 3*c*, which beams 3*a*, 3*b*, 3*c*, 3*d* are connected to each other at corners of the first frame 3. In addition, the first frame 3 comprises in its middle part two parallel inner cross beams 3*c*', 3*d*' which have essentially the same length as the first and second outer cross beams 3*c*, 3*d*, to which they are parallel, and two parallel inner longitudinal beams 3*a*', 3*b*' which are parallel to the two outer longitudinal beams 3*a*, 3*b* but only have about half the length of the latter or less. The inner longitudinal beams 3*a*', 3*b*' interconnect the two inner cross beams 3*c*', 3*d*' to form a support frame for the swivel connection 7.

The second, lower, frame 5 is correspondingly shaped as the first frame 3. In fact, they are of the same make, i.e. identical frames 3, 5 inasmuch as the beam structure is concerned. Therefore, the numbering of the beams 5*a*, 5*b*, 5*c*, 5*d*, 5*a*', 5*b*', 5*c*', 5*d*' of the second frame 5 corresponds directly to the numbering of the beams 3*a*, 3*b*, 3*c*, 3*d*, 3*a*', 3*b*', 3*c*', 3*d*' of the first frame 3 with respect to their position (which is simply a vertical downwards projection of the latter beams 3*a*, 3*b*, 3*c*, 3*d*, 3*a*', 3*b*', 3*c*', 3*d*') and dimensions and also with respect to their mechanical function within the frames 3, 5. The function of the frames 3, 5 is however a different one which is why the first frame 3 is equipped with upwards projecting connectors 13*a*, 13*b*, 13*c*, 13*d* at its corners (i.e. where the outer beams 3*a*, 3*b*, 3*c*, 3*d* are connected to each other), whereas the second frame 5 comprises a blade gripping assembly 16 which faces downwards and which comprises two blade gripping tools 11*a*, 11 *b* which project downwards rectangular from the second frame 5 to which they are permanently connected.

In this context, it is to be understood that the blade gripping device 1, which forms a blade assembly 2 together with the rotor blade 9, is shown in both depictions in a designated operating position: That means that both frames 3, 5 are essentially horizontally aligned which can be realized by suspending the blade gripping device 1 via the connectors 13*a*, 13*b*, 13*c*, 13*d* from a lifting device such as a crane (not shown) with ropes or chains (not shown) which each have the same length from the connectors 13*a*, 13*b*, 13*c*, 13*d* to a common interconnection point, e.g. the lifting device's hook. Such horizontal alignment of the blade gripping device 1 results also in an essentially horizontal alignment of the rotor blade 9.

In FIG. 1, there can also be seen a sensor arrangement 14 which comprises a number of sensors 18, 20 and a position computation unit 10 as a recognition unit 10, as well as a number of position adjustment assistance means or device 22, 24, 26:

A first sensor 18 positioned about the support frame of the second frame 5 and facing downwards towards the rotor blade 9 comprises a camera sensor 18 which operates at a wavelength perceptible to the human eye. This camera sensor 18 thus produces pictures or movies of the rotor blade 9 during the process of advancing the blade gripping device 1 to the rotor blade 9 and during the connection process of the rotor blade 9 to the blade gripping device 1. These pictures or movies are used as sensor data SD which are transferred wirelessly or via communication lines to the position computation unit 10 which therefrom computes a specific position of the rotor blade 9, for instance a position of the rotor blade 9 relative to the blade gripping device 1. Similarly, a set of second sensors 20 are realized to detect a magnetic field. For that purpose, the second sensors 20 comprise Hall effect sensors 20. They interact with magnetic markers 12 of the rotor blade 9. Again, the sensor data SD of the second sensors 20 are transferred to the position computation unit 10 which therefrom computes a specific position of the rotor blade 9, for instance a position of the rotor blade 9 relative to the blade gripping device 1.

The position adjustment assistance means or device 22, 24, 26 comprise a display 22 which in particular can display the pictures and/or movies from the first sensor 18, an acoustic and/or optical signal generating unit 24 which outputs sound and/or light signals which signals are representative of the detected position and an automatic movement mechanism 26. Such automatic movement mechanism 26 automatically moves the blade gripping tools 11*a*, 11*b* into a predefined gripping position with respect to the rotor blade 9.

To sum up, by means of the sensor arrangement 14 it is possible to compute the position of the blade gripping device 1 relative to the rotor blade 9 and to further assist an operator and/or the automatic movement mechanism 26 to move the blade gripping device 1 and/or parts thereof, in particular the second frame 5 relative to the rotor blade 9 in order to put it into a position in which the blade gripping tools 11*a*, 11*b* can grip the rotor blade 9 in a desired position. Such position is preferably such that the centre of gravity of the rotor blade 9 is essentially below the centre of gravity of the blade gripping device 1. Furthermore, the position computation unit 10 may further be connected to the automatic receptor system according to embodiments of the invention (not shown in FIG. 1) to detect the position and the rotating position of the receptor of the automatic receptor system. In this context, the position computation unit may be connected to a sensor arrangement, which is part of the automated receptor system and is designed to detect the rotation position of the receptor of the automated receptor system.

Figure 2:
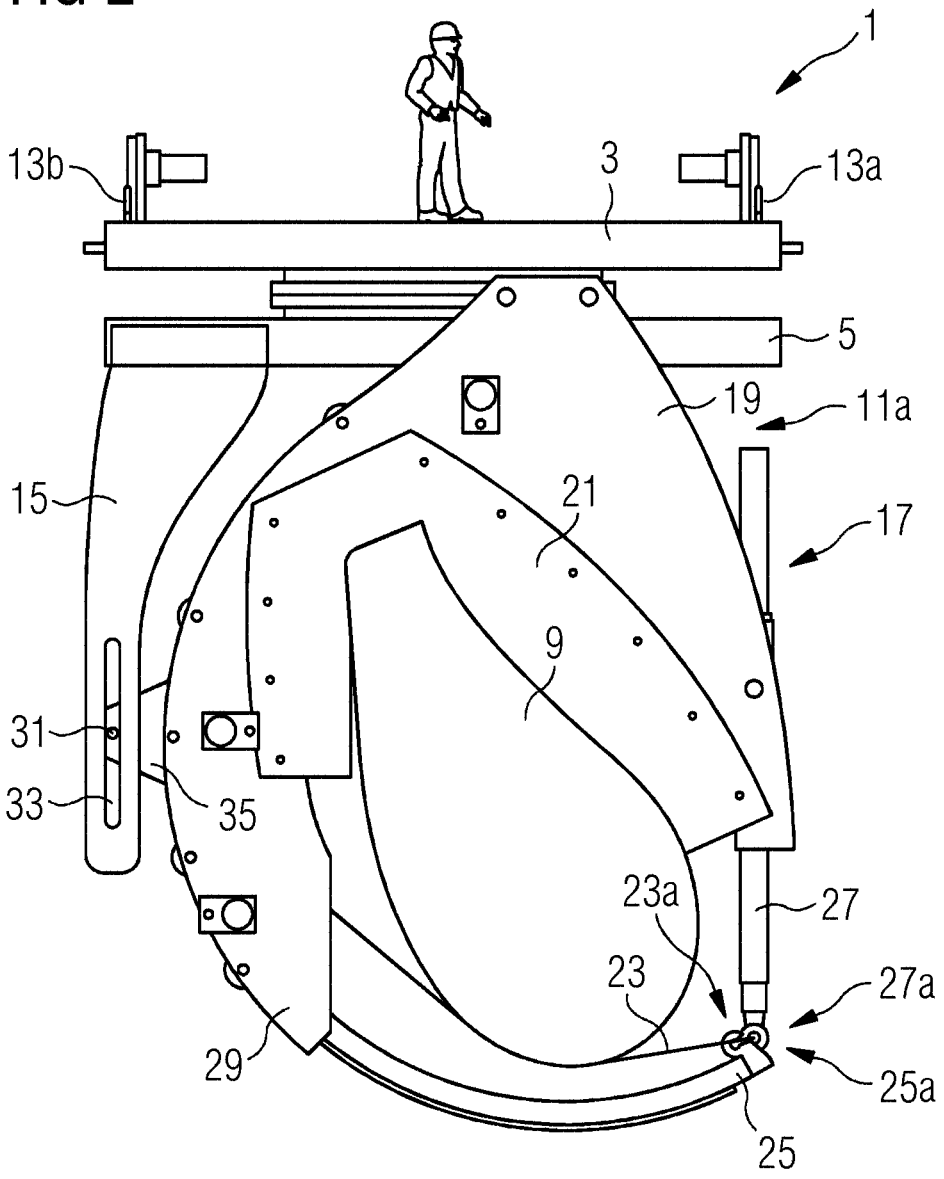
FIG. 2 shows a side view of the same blade gripping device.

FIG. 2 shows a front view of the same blade gripping device 1. In particular, the blade gripping tool 11*a* (also shown in FIG. 1) can be seen in more detail. The blade gripping tool 11*a* comprises a seat 21 to accommodate the rotor blade 9 in its upward directed part of its circumference. The seat 21 is firmly connected to a frame 19 which frame 19 accommodates a sling handover mechanism 17. The sling handover mechanism 17 comprises a sling-conveying element 25 at one side of the rotor blade 9 and a sling-receiving element 27 at the opposite side of the rotor blade 9 along its circumference. Further the sling handover mechanism 17 comprises a sling 23. The sling-conveying element 25 and the sling 23 are retractable into an accommodation section 29 of the frame 19. The sling-conveying element 25 has a curved shape which is essentially a circular shape, i.e. formed as a part of a circle. It comprises a single-piece guidearm 25 and an engaging element 25*a* to which there is connected a connection means or device 23*a* of the sling 23. The connection means or device 23*a* comprises an end ring 23*a* of the sling 23 which is connected to the sling 23 at one of its ends. Correspondingly, the sling-receiving element 27 comprises a receptor 30 realized as a hook 27*a*.

At the left, the blade gripping tool 11*a* comprises a guiding frame 15 with a guiding cavity 33 which interacts with a pin 31 of a guiding element 35. That guiding element 35 is firmly connected to the frame 19.

In the context of FIG. 2 it may be noted that the guidearm 25 of the sling-conveying element 25 is positioned in a handover position. Correspondingly, the sling 23 is connected to the engaging element 25*a* of the sling-conveying element 25 by the connection means or device 23*a* of the sling 23 and currently being handed over to the receptor 27*a* of the sling-receiving element 27. That means, the sling 23 has been moved along a two-dimensional path of travel from the one side of the rotor blade 9 (i.e. the left) below the rotor blade 9 to its opposite side. The sling 23 thereby serves to firmly grip the rotor blade 9 together with the seat 21.

Figure 3:
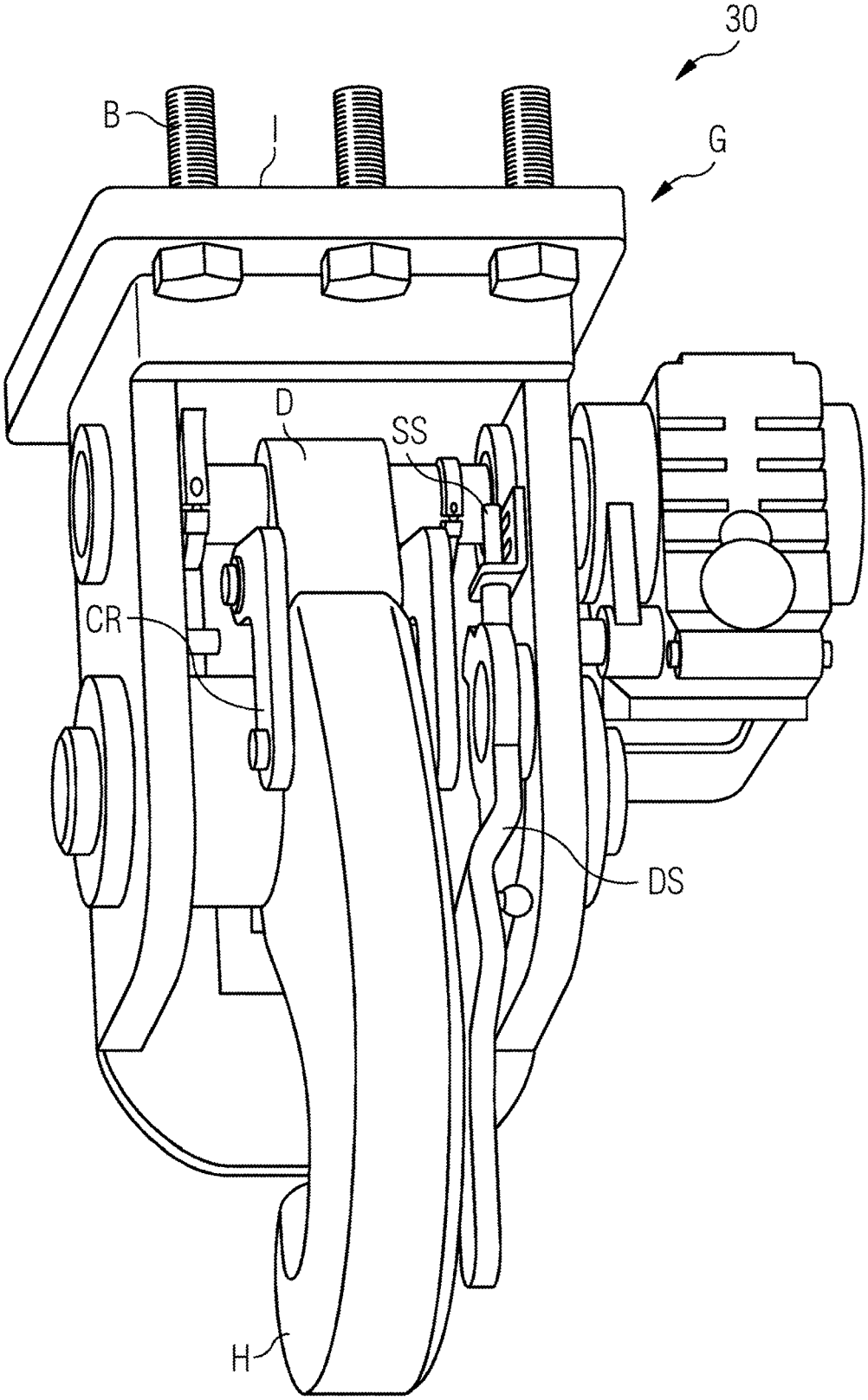
FIG. 3 shows a perspective view of an automated receptor system according to an embodiment of the invention.
Figure 4:
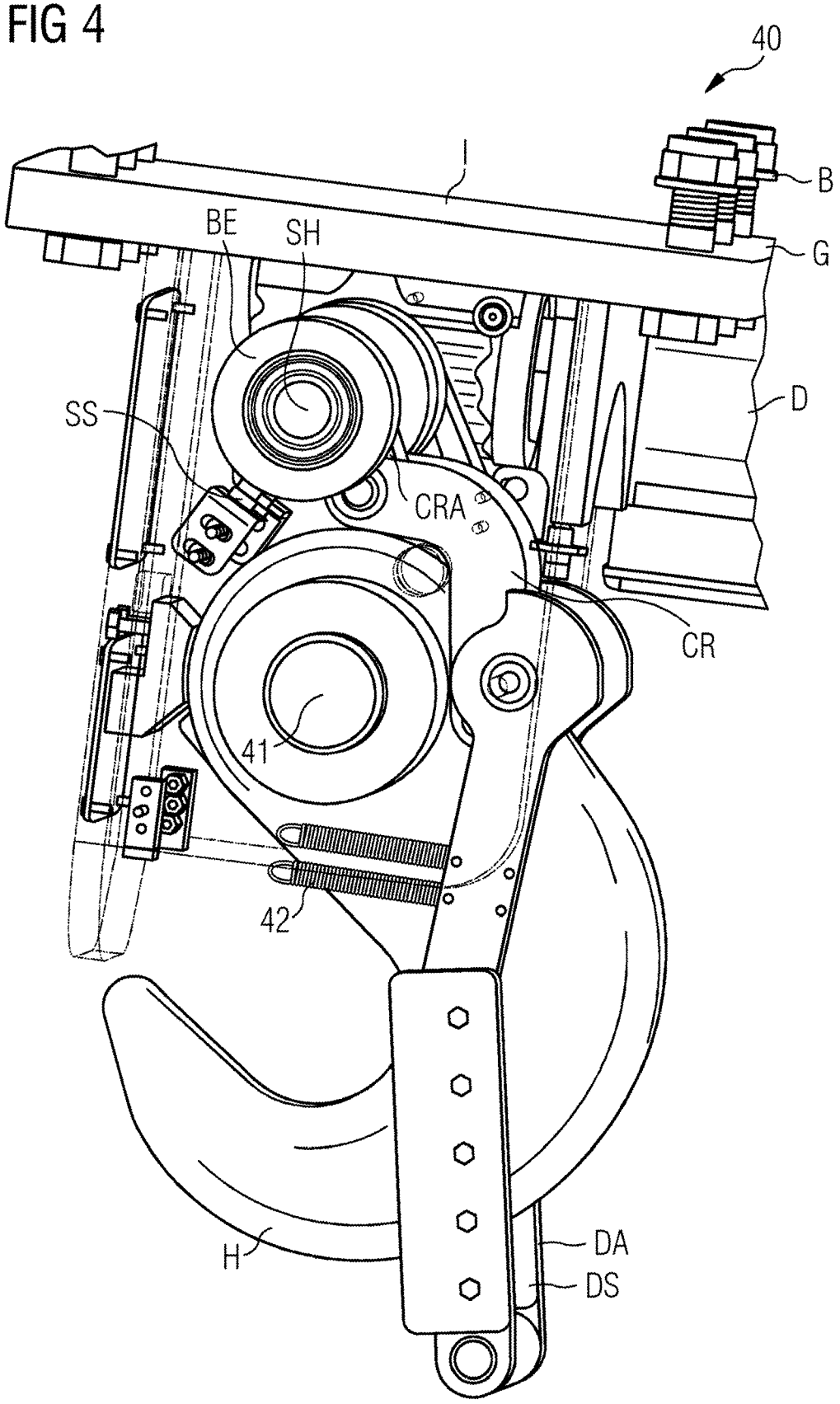
FIG. 4 shows a side view of an automated receptor system according to an embodiment of the invention, wherein the receptor is in closed position.
Figure 5:
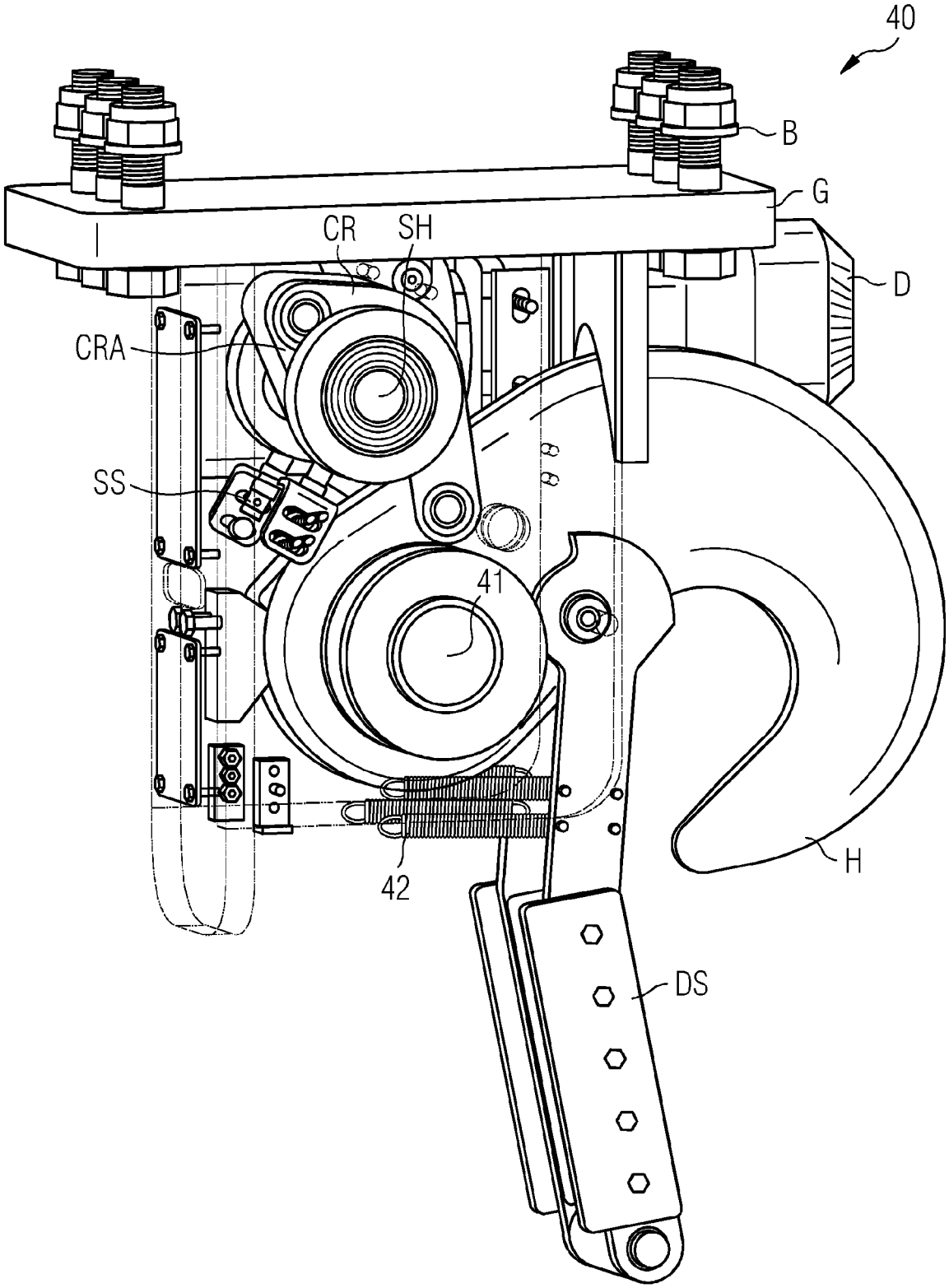
FIG. 5 shows a side view of the same automated receptor in an open position.

FIG. 3 to FIG. 5 show perspective views of an automated receptor system according to an embodiment of the invention, which automated receptor system may be part of the sling receiving element 27 shown in FIG. 2 or may be mounted to the blade gripping device 1 shown in FIG. 2 instead of the receptor 27*a* of the sling-receiving element 27 shown in FIG. 2. FIG. 6 to FIG. 11 show details of an automated receptor system according to an embodiment of the invention.

FIG. 3 shows a perspective view of an automated receptor system 30 according to an embodiment of the invention. The automated receptor system 30 can be mounted on the sling receiving element 27 instead of the receptor 27 shown in FIGS. 1 and 2. The automated receptor system 30 comprises a housing G, which is machined for fitting a carrying interface I of the receptor system 30 and some bearings of the rotating or pivoting parts D, H of the automated receptor system 30. The carrying interface I has a number of bolts B, which are used to fix the automated receptor system 30 to the sling receiving element 27 (shown in FIGS. 1 and 2) or to a support of the sling receiving element 27. The housing G is shown in detail in FIG. 6. In the upper part of the housing G, i.e. the part facing the carrying interface I of the automated receptor system 30, a drive system D is mounted, which is shown in detail in FIG. 7. The drive system D is designed to drive a pivoting movement of a hook H, which is shown in the lower part, i.e. the part opposed to the carrying interface I of the automated receptor system 30. As will be described later with reference to FIG. 7, the drive system D comprises an electrical motor M placed on a gear. The gear is mounted with a crank shaft SH and a torque arm CRA on the crank shaft, i.e. a crank for transmitting the torque of the motor to a receptor, in particular a hook. The electric power for the electrical motor M can be supplied by a cable from the blade gripping device 1. As can be taken from FIG. 3, additionally there is a connecting rod CR, which is mounted with its one end to the drive system D and with its other end to a receptor, particularly a hook H. The connecting rod CR is designed to transmit torque from the drive system D to the hook H. The hook H will be shown in detail in FIG. 10. Furthermore, FIG. 3 shows a sensor system SS for detecting whether the hook H is opened or closed, which sensor system SS will be shown in detail in FIG. 8. Moreover, the automated receptor system comprises a detection system DS for detecting whether a connection means or device 23*a* (shown in FIG. 2) is in a correct position, which is suitable to receive the connection means or device 23*a* by closing the hook H. The detection system DS will be shown in detail in FIG. 9.

In FIG. 4, a side view of an automated receptor system 40 according to an embodiment of the invention is shown in the closed position, which means that the hook H is oriented in vertical direction, i.e. the hook H is in vertical position, wherein the vertical direction is the direction, which is perpendicular to the surface of the carrying interface I or parallel to the longitudinal axis of the bolts B of the carrying interface I. As it can be further taken from FIG. 4, the connecting rod CR is in a lower position, which means that it is positioned next to the hook H and distant from the carrying interface I of the automated receptor system 40. Further, FIG. 4 shows a crank CRA, which is part of the drive system D. As it can be also seen in FIG. 4, the crank CRA of the crank shaft SH is also in a lower position, which means that it is positioned next to the hook H and distant from the carrying interface I of the automated receptor system 40. In addition to the features already well known from FIG. 3, i.e. the drive system D, the sensor system SS, the detection system DS and the connecting rod CR, there are some additional details in FIG. 4, which is a bearing BE for pivoting the crank shaft SH of the drive system D. Further, the automated receptor system 40 comprises an additional bearing 41 positioned on the upper end of the hook H, which is designed to pivot the hook H in the housing G. Furthermore, there are some springs 42 on the bottom end of the housing G connecting the housing G to a detector arm DA of the detection system DS shown in detail in FIG. 9. The detector arm DA is rotatably mounted to the housing G.

In FIG. 5, a side view of the automated receptor system 40 according to an embodiment of the invention is shown in the open position, which means that the hook H is rotated to an approximately horizontal position, wherein the horizontal position is oriented to the direction, which is parallel to the surface of the carrying interface I or perpendicular to the longitudinal axis of the bolts B of the carrying interface I. As it can be further taken from FIG. 5, the connecting rod CR between the drive system D and the hook H is in an upper position, which means that it is positioned facing the carrying interface I of the automated receptor system 40. As it can be also seen in FIG. 5, the crank CRA of the crank shaft SH is also in an upper position, which means that it is positioned next to the carrying interface I of the automated receptor system 40. As can be further taken from FIG. 5, the sensor system SS is positioned next to the crank shaft SH and is designed to detect the change of the rotation of the crank shaft SH.

Figure 6:
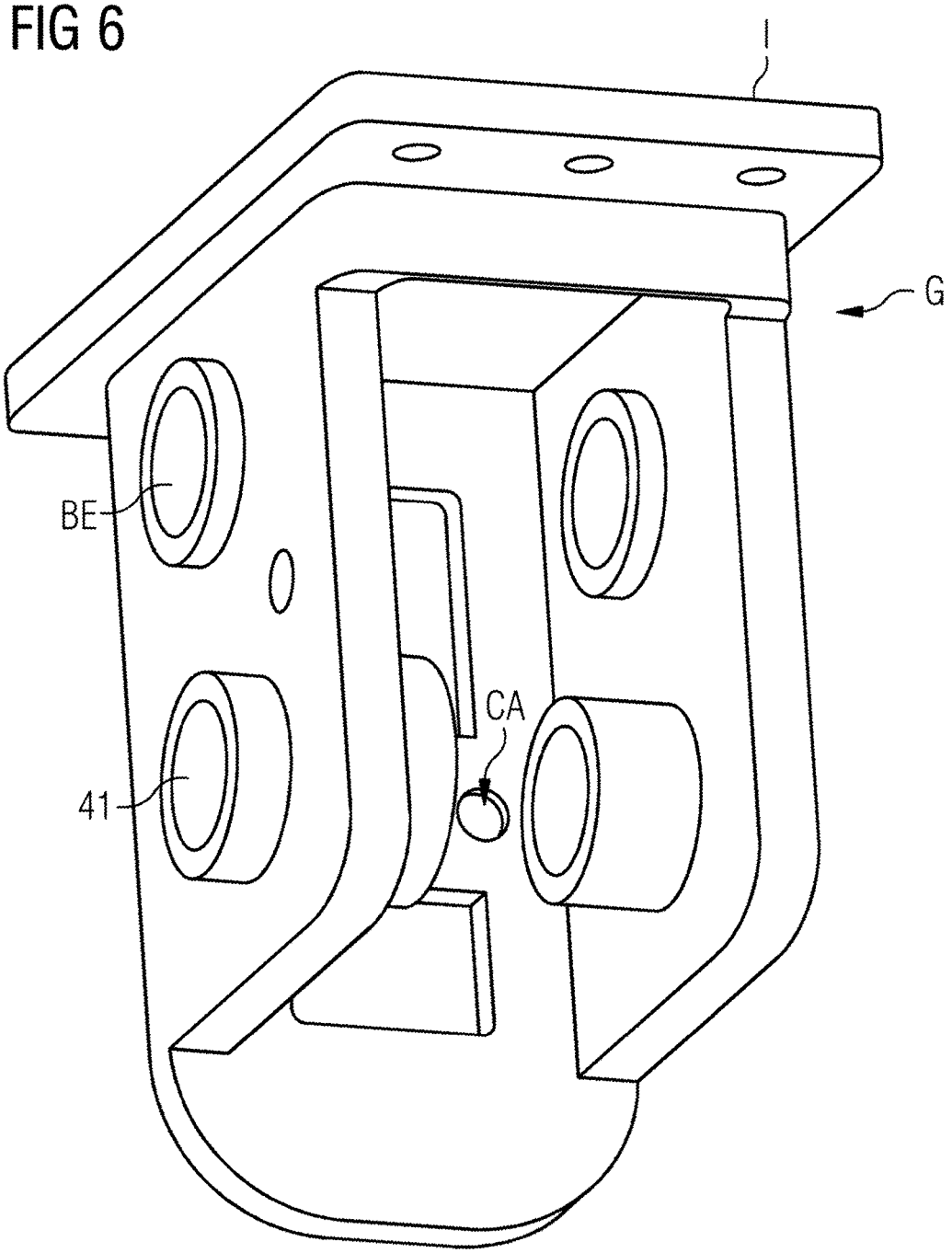
FIG. 6 shows a detailed view of a housing of an automated receptor system according to an embodiment of the invention.

In FIG. 6 a detailed view of a housing G of an automated receptor system according to an embodiment of the invention is shown. The housing G may be made from steel and may be carried out to fit a carrying interface I on the upper end of the housing G, the bearings BE of the crank shaft (not shown in FIG. 6) and the bearings 41 of the hook H. Each of the bearings BE, 41 has a circular opening and the bearings BE, 41 are positioned at both side surfaces of the housing G such that a rotatable shaft can be inserted into the circular openings of the bearings BE, 41. Further, there is a through hole CA in the backside of the housing G, which is designed as a cable outlet for example for guiding an electric cable through the backside of the housing G for supporting the sensor systems SS, DS with electric power.

Figure 7:
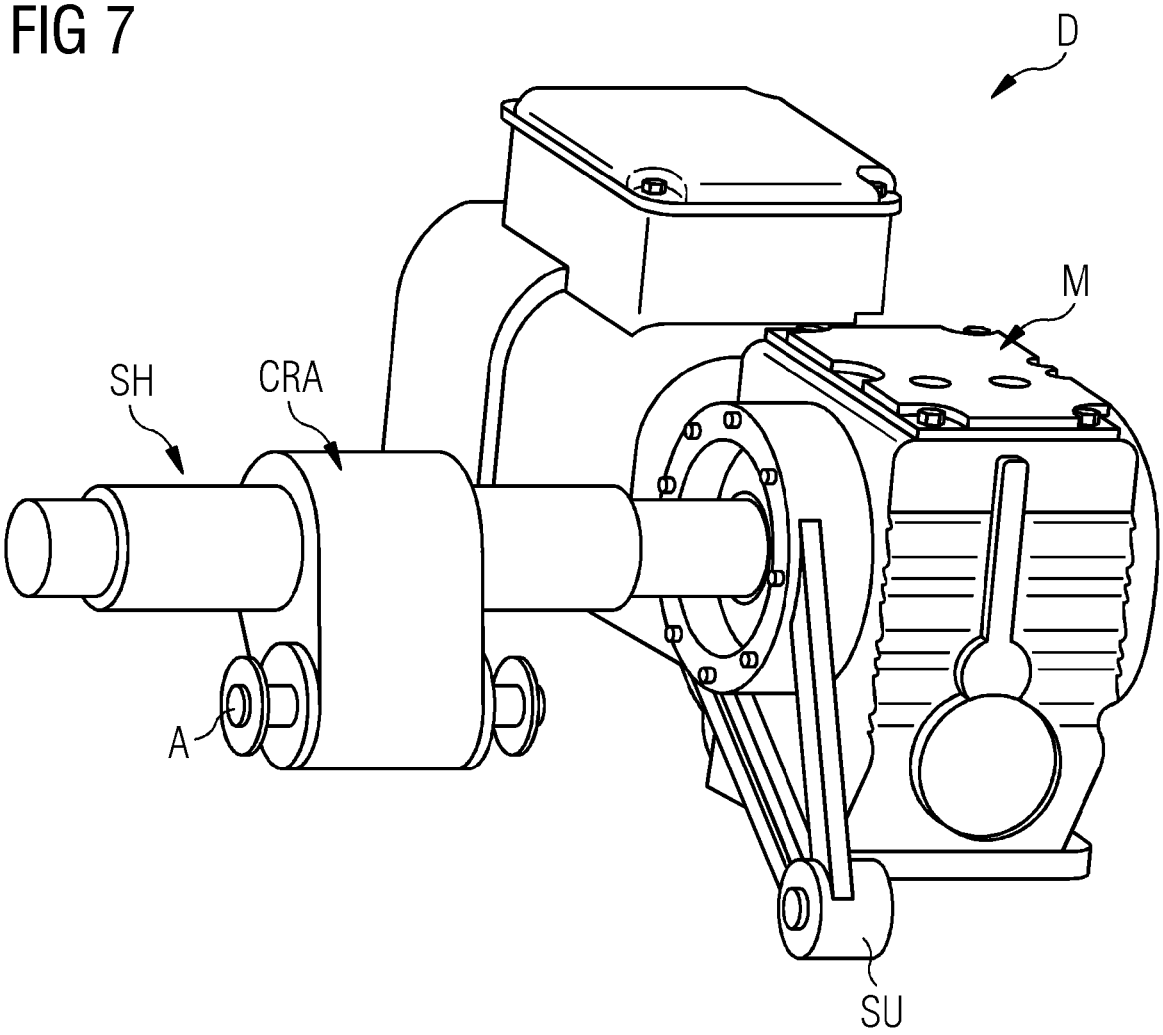
FIG. 7 shows a detailed view of a driving system of an automated receptor system according to an embodiment of the invention.

FIG. 7 shows a detailed view of a drive system D of an automated receptor system 30, 40 according to an embodiment of the invention. The drive system D comprises an electrical motor M placed on a gear. The gear is mounted with a shaft SH and a torque arm CRA, i.e. a crank for transmitting the torque of the motor to a hook. Through the end of the crank CRA distant from the crank shaft SH, a rotatable axle A is guided through, which connects the crank CRA to a connecting rod CR shown in FIG. 11. The electrical motor M may additionally comprise a brake. The brake may be an electromagnetic brake which is designed to block the rotation of the motor and the shaft, if the hook H is closed, i.e. the gripping device 1 of FIG. 1 has gripped a load and a rotation motion of the hook H has to be prevented. Furthermore, there is a support SU mounted on the drive system at the position, where the crank shaft SH comes out of the electrical motor M.

Figure 8:
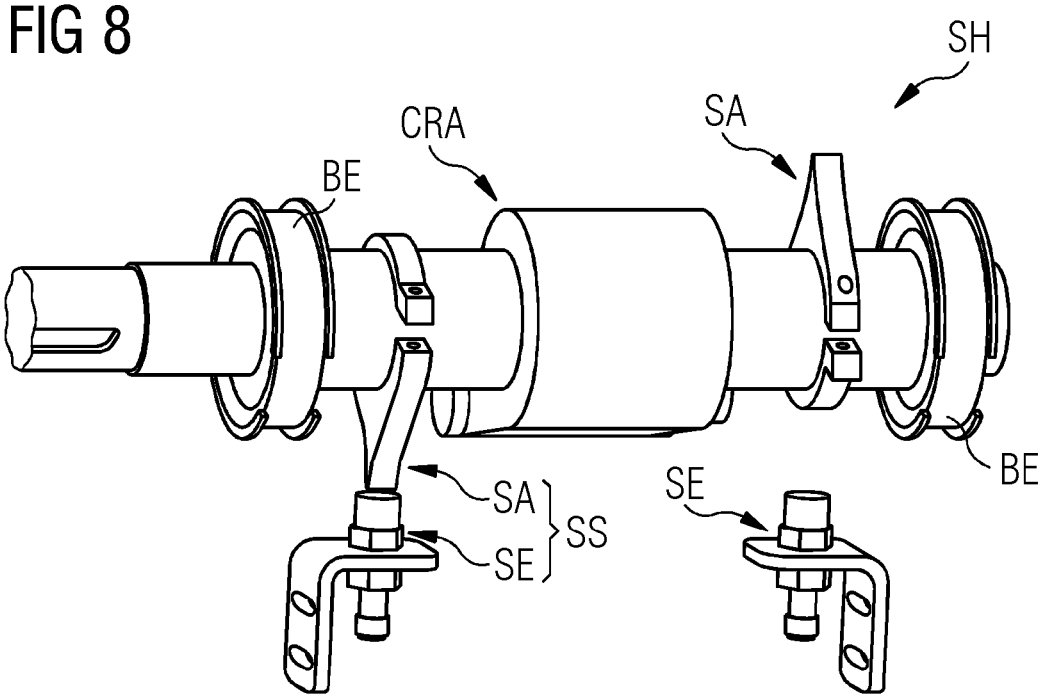
FIG. 8 shows a detailed view of a crank shaft of a driving system of an automated receptor system according to an embodiment of the invention.

FIG. 8 shows a detailed view of a crank shaft SH of a drive system (as shown in FIG. 7) of an automated receptor system 30, 40 (as shown in FIG. 3 or 4) according to an embodiment of the invention. The crank shaft SH comprises a crank CRA with the function as mentioned above. Further, there are two bearings BE mounted around the crank shaft SH at both ends of the crank shaft SH. Furthermore, there is a crank CRA fixedly mounted to the crank shaft SH, which has the above-mentioned function of transmitting a torque from the crank shaft SH to a hook H (not shown in FIG. 8). Moreover, there are two sensor units SS positioned between the crank CRA and the bearings BE, respectively, wherein each of the sensor units SS comprises a sensor arm SA mounted on the crank shaft SH and a sensor SE which is fixedly mounted on the housing G (not shown in FIG. 8) and is positioned at the same vertical plane as the sensor arm in such a manner that a distance between the sensor SE and the sensor arm SA rotating with the crank shaft SH can be detected by the sensor SE. For instance, the sensor arm SA has a shape, which differs depending from the azimuth. Due to the azimuthal change of the shape of the sensor arm SA, the distance between the sensor arm SA and the sensor SE varies with the rotation of the crank shaft SH. Hence the rotation position of the crank shaft SH and thus the rotation position of the receptor, i.e. the hook H may be detected by the sensor.

Figure 9:
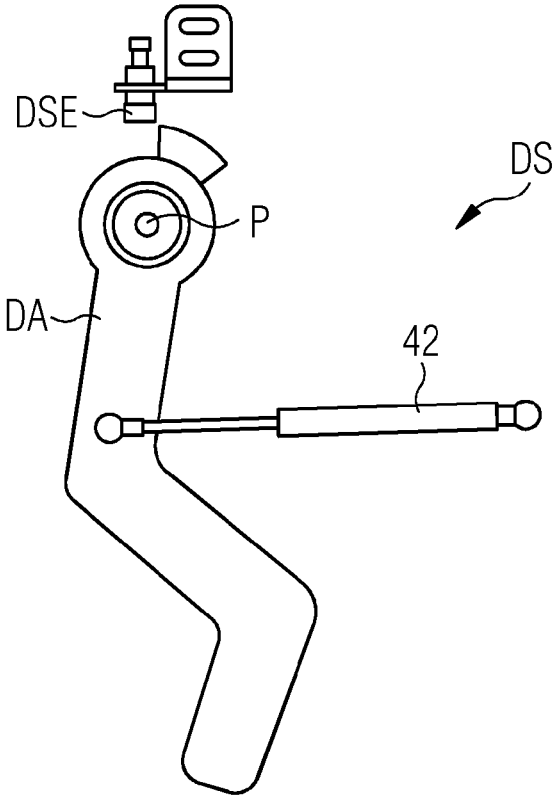
FIG. 9 shows a detailed view of a detection system for detecting whether the connection means or device is in the correct position

FIG. 9 shows a detailed view of a detection system DS for detecting whether the connection means or device, i.e. a sling ring etc., is in the correct position. The complete process of receiving a connection means or device will be shown in FIG. 12. In FIG. 9 the detector system DS comprises a detector arm DA, which is formed like an "s" and has on its upper end, which is the end faced to the upper end of the automated receptor system, i.e. the position of interface I (shown in FIG. 6), a circular pit P corresponding to a retaining element at the housing (not shown in FIG. 9).

Further, a marker MK is formed at the upper end of the detector arm DA, for example as a circular sector, which is designed to indicate a rotating position, i.e. an orientation of the detector arm DA relative to a detector sensor DSE, which may be mounted next to the upper end of the detector arm DA and may be fixed to the housing (not shown in FIG. 9) of the automated receptor system. Furthermore, the detection system DS also comprises a spring 42, for example a gas spring, which exerts a restoring force on the detector arm DA and holds the detector arm DA in a vertical position in all cases with the exception of the step of receiving a connection means or device by the hook (shown in FIG. 12, second drawing).

Figure 10:
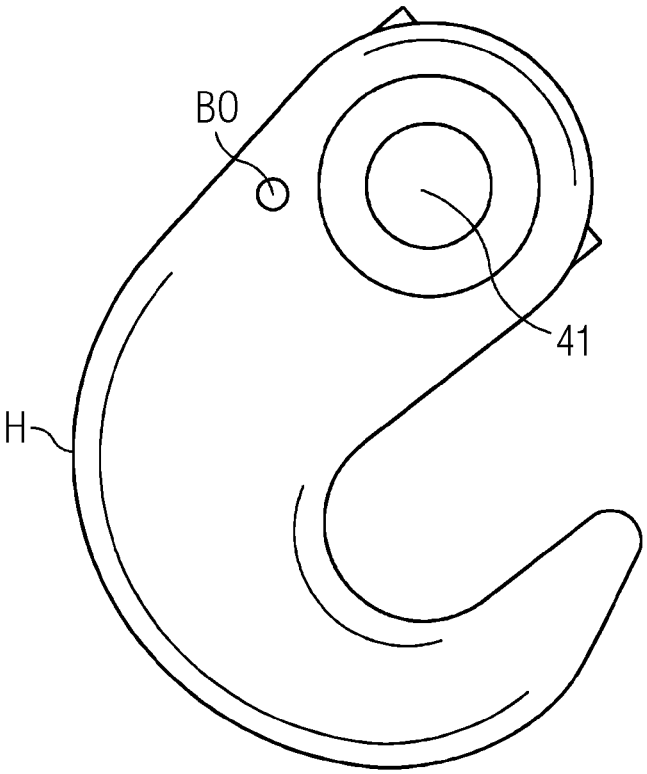
FIG. 10 shows a side view of a receptor, i.e. a hook of an automated receptor system according to an embodiment of the invention.

FIG. 10 shows a side view of a receptor, i.e. in particular a hook H of an automated receptor system (as for example shown in FIG. 3) according to an embodiment of the invention. The hook H comprises a bearing 41 for rotating the hook H around a supporting axle (as shown in FIGS. 3 and 4) on its upper end, which is the end facing the drive system (not shown in FIG. 10) of the automated receptor system. Further, the hook H comprises an additional circular boring BO, which is positioned eccentrically to the centre of the bearing 41 of the hook H. The additional boring BO is designed to engage with a connecting rod CR, which will be shown in detail in FIG. 11. The connecting rod CR is designed to transmit torque from the drive system D (shown in FIG. 7) to the hook H, i.e the connecting rod CR transmits a rotational movement of the drive system to the hook H such that the hook H is pivoted into vertical or horizontal position, depending on whether a load is received by the hook H or a load is released from the hook H, as it is shown in detail in FIGS. 12 and 13, respectively.

Figure 11:
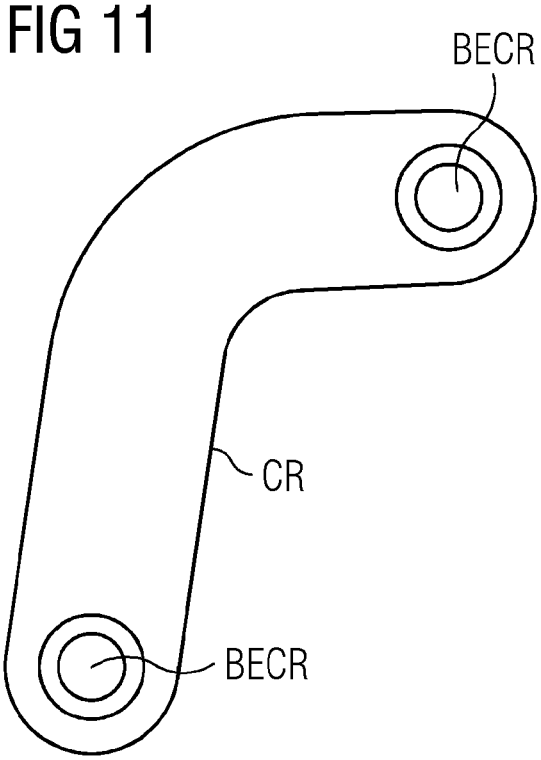
FIG. 11 shows a side view of a connecting rod connected between a crank shaft and a hook of an automated receptor system according to an embodiment of the invention.

FIG. 11 shows a side view of a connecting rod CR connected between a crank shaft and a hook (both not shown in FIG. 11) of an automated receptor system according to an embodiment of the invention. The connecting rod CR has the shape of a reversed "L" and has circular borings at its both ends for receiving a bearing BECR at both ends, respectively. As it is shown in FIG. 3 to FIG. 5, the connecting rod CR is designed to transmit torque from the drive system D to the hook H.

Figure 12:
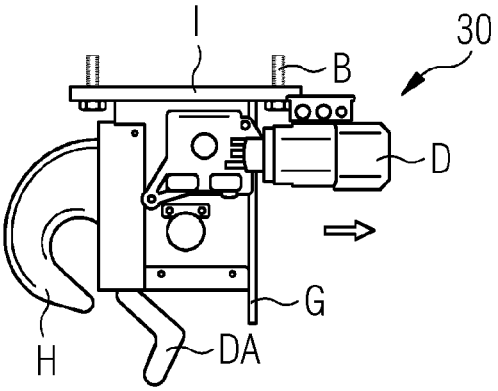
FIG. 12 shows a side view of an automated receptor system according to an embodiment of the invention step by step in process of receiving a connection means or device.
Figure 12:
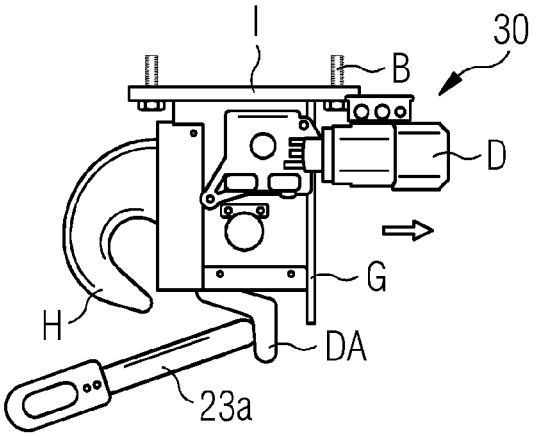
Figure 12:
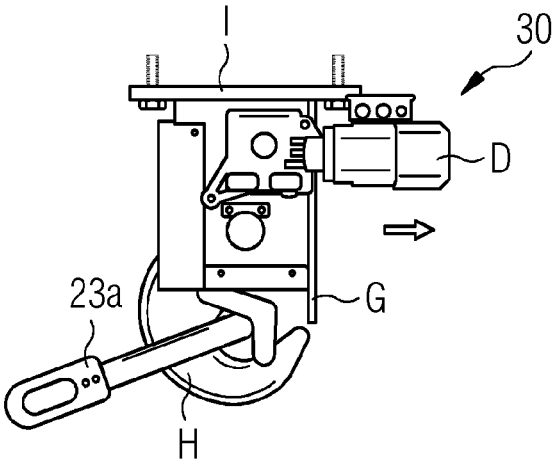
Figure 12:
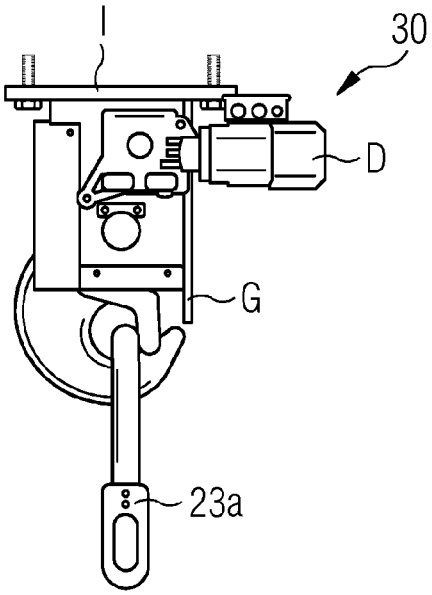

FIG. 12 shows a side view of an automated receptor system 30 according to an embodiment of the invention step by step in process of receiving or pick-up a connection means or device 23*a*, i.e. loading the connection means or device 23*a*. In the first step 12.I, the hook H of the receptor system 30 is open, which means that the hook H is rotated to a horizontal position approximately oriented in a horizontal direction, wherein the horizontal direction is the direction, which is parallel to the surface of the carrying interface I. In a second step 12.II, a connection means or device 23*a*, i.e. a sling with a D-ring a its end contacts the detector arm DA of the detection system of the automated receptor system 30 such that the detector arm DA is rotated counter clockwise, wherein the rotation of the detector arm DA is detected by the detector system DS (shown in detail in FIG. 9). Detection of rotation of the detector arm DA may be reported to a remotely positioned operator, wherein the operator controls a subsequent motion of the hook H. Alternatively the detection of rotation may be evaluated completely automatically and an order of closing the hook H is transmitted to the drive system D completely without any intervention of an operator. After detection of the connecting means or device 23*a* in the correct position, in the third step 12.III the hook H is rotated into closed position, which means that the hook H is rotated clockwise into a vertical position oriented in a vertical direction, wherein the vertical direction is the direction, which is perpendicular to the surface of the carrying interface I or parallel to the longitudinal axes of the bolts B of the carrying interface I. As mentioned-above, the command to close the hook and receive the connection means or device can be given by an operator or automatically. In the fourth step 12.IV, the end position is accomplished, wherein the connection means or device 23*a* is vertically oriented.

Figure 13:
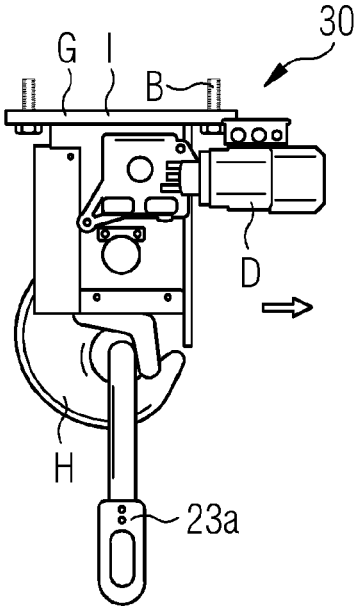
FIG. 13 shows a side view of an automated receptor system according to an embodiment of the invention step by step in process of releasing a connection means or device.
Figure 13:
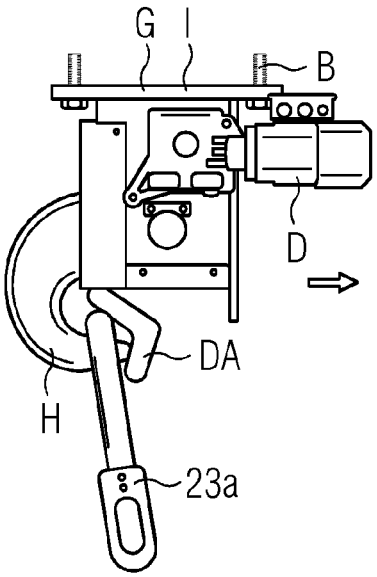
Figure 13:
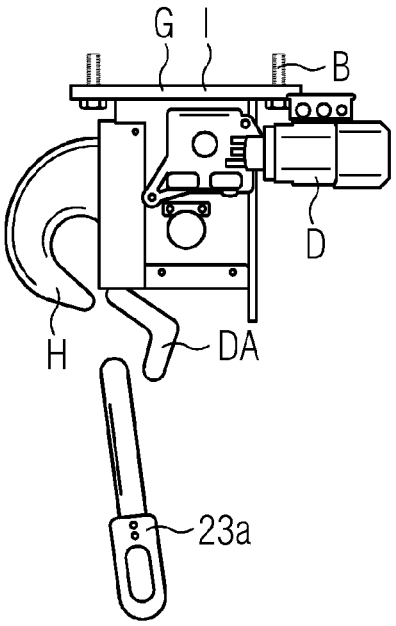
Figure 13:
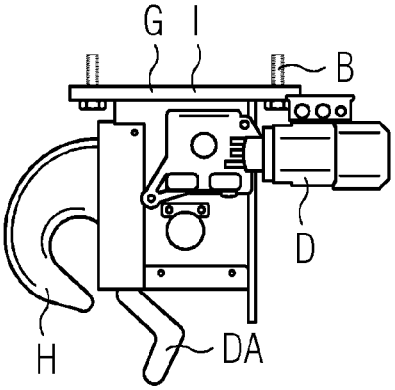

FIG. 13 shows a view of an automated receptor system 30 according to an embodiment of the invention step by step in process of releasing a connection means or device 23*a*, i.e unloading the connection means or device 23*a*. In the first step 13.I, the automated hook system 30 is in the start position, wherein the connection means or device 23*a* is vertically oriented. In the second step 13.II, the hook H starts to be rotated clockwise into an approximately horizontal position. In the third step 13.III the hook H is in the horizontal position such that the connection means or device 23*a*, i.e. a sling with a D-ring is released from the hook H due to gravity. In the fourth step 13.IV, the hook H of the receptor system 30 is kept open, which means that the rotation position of the hook H of step 13.III has not changed.

Figure 14:
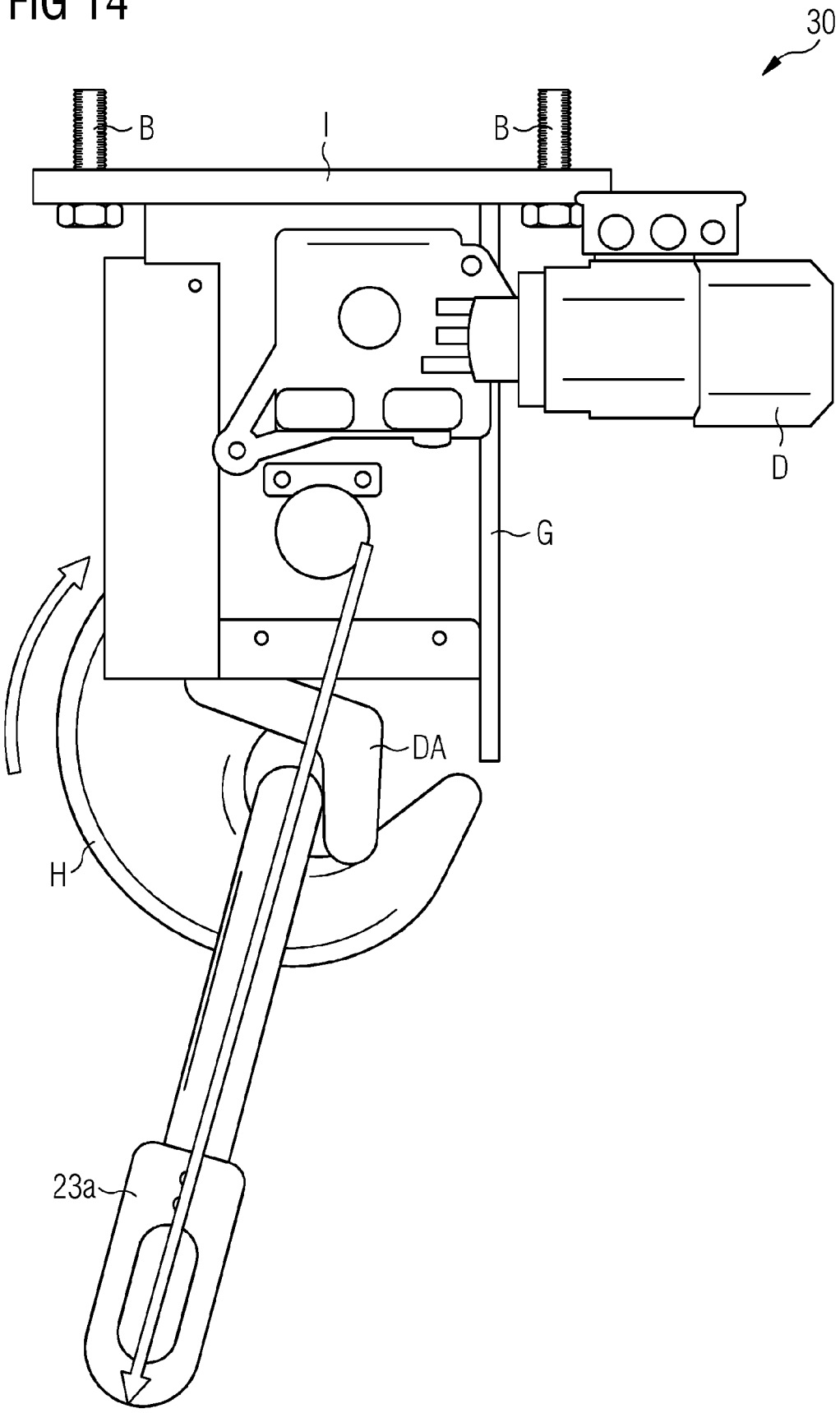
FIG. 14 shows a side view of an automated receptor system according to an embodiment of the invention connected to a connection means or device in a position, wherein a high torque is exerted on the automated receptor.
Figure 15:
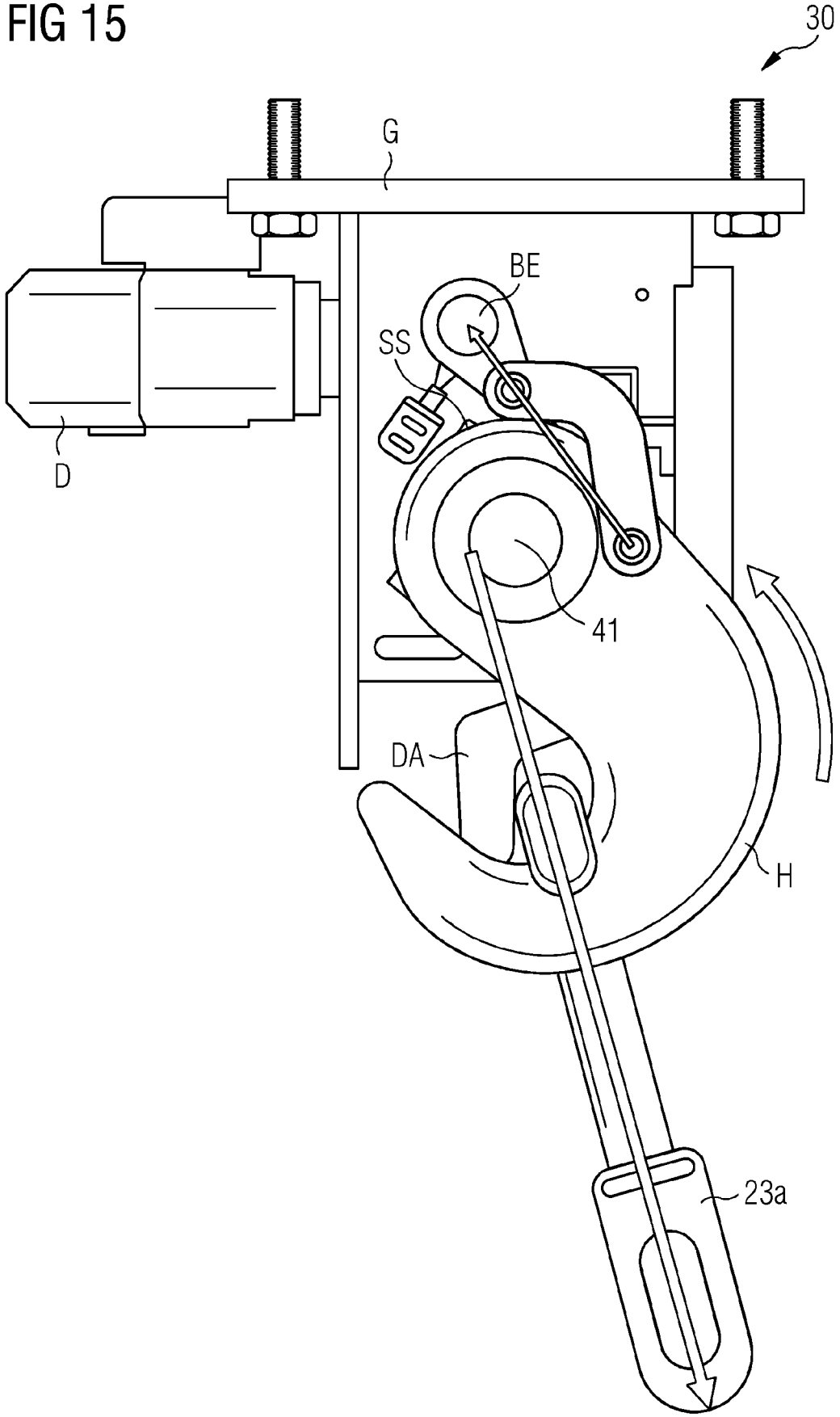
FIG. 15 shows a side view of the automated receptor system in FIG. 14 from the opposite direction.

FIG. 14 and FIG. 15 show side views of an automated receptor system 30 according to an embodiment of the invention connected to a connection means or device 23*a* in a position, wherein a high torque is exerted on the hook H of the automated receptor system 30. FIG. 15 shows the side view from the opposite direction as shown in FIG. 14. High torque is exerted on the hook system 30, if the hook H is not loaded directly vertical under the hanging point of the hook H, which may result in a sliding of the connection means or device 23*a* in the hook H. As you can see in FIGS. 14 and 15, in case of an inclined orientation of the connection means or device 23*a*, a force (symbolized by a long arrow) is exerted on a peripheral point of the rotation axis such that a high torque is exerted on the rotation axis of the hook H. In order to protect the motor and the gear of the drive system D from being overloaded, the rotation of the hook H is electrically and mechanically blocked i.e. locked. Electrical locking is for example accomplished by electrical and/or magnetic power, as for example an electrical brake in the electrical motor. Mechanical locking is accomplished, since the hook H abuts against the crank CRA of the drive system D in case the crank is fixed by the electrical brake as it can be seen in detail in FIG. 16.

Figure 16:
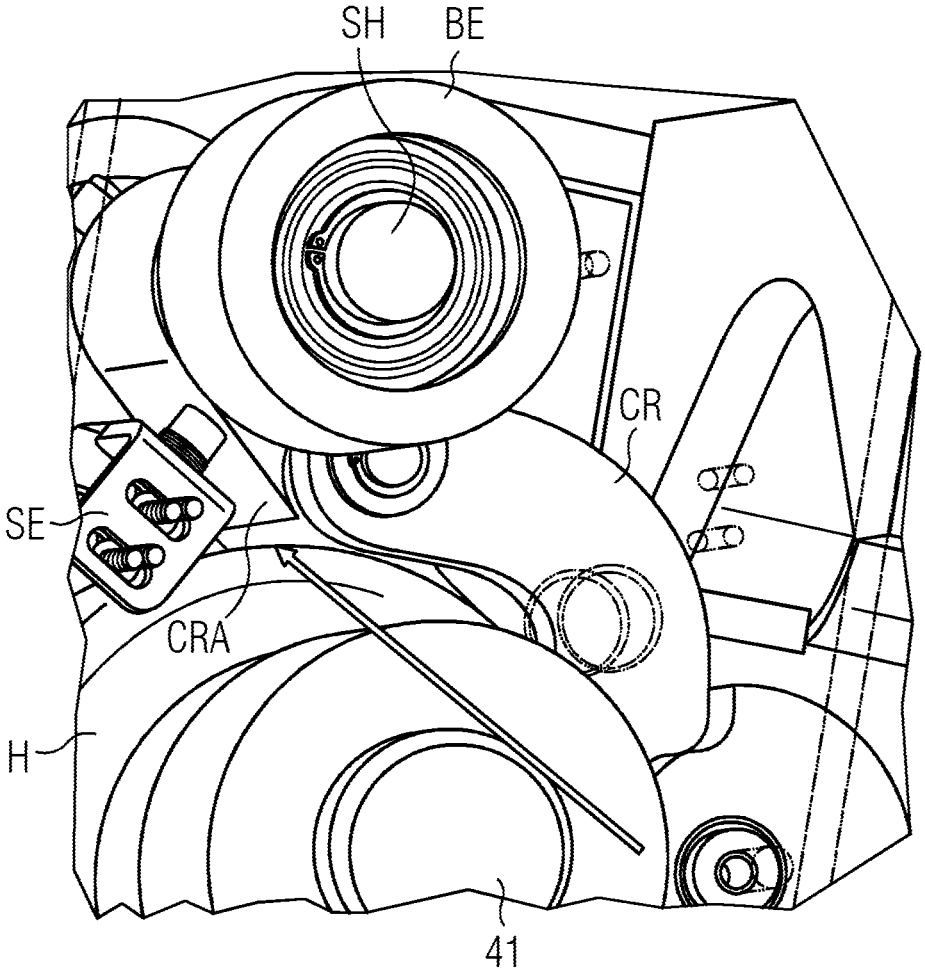
FIG. 16 shows a perspective view of the mechanical and electrical locking of a hook of an automated receptor system in case of high torque being exerted on the hook.

FIG. 16 shows a perspective view of the mechanical locking of the automated hook H in case of high torque exerted on the automated hook H. When the crank CRA is stopped by the electrical brake of the drive system D, the upper part of the hook H abuts against the crank CRA, which results in a locking of the hook H such that the rotation movement of the hook H is blocked and consequently there is no rotation movement of the crank shaft of the drive system D of the automated receptor system 30 exerted on the drive system D.

Although the present invention has been disclosed in the form of preferred embodiments and variations thereon, it will be understood that numerous additional modifications and variations could be made thereto without departing from the scope of the invention.

For the sake of clarity, it is to be understood that the use of 'a' or 'an' throughout this application does not exclude a plurality, and 'comprising' does not exclude other steps or elements.

The invention claimed is:

1. An automated receptor system of a sling-receiving element for gripping a connection device of a sling of a blade gripping device for gripping a rotor blade of a wind turbine, which automated receptor system comprises:

a receptor for connecting the connection device to the sling-receiving element, a drive system for pivoting the receptor for coupling the connection device to the sling-receiving element and for decoupling the connection device from the sling-receiving element, and a receptor locking system, wherein the receptor locking system is based on electromagnetic power and mechanical power, wherein, in case the receptor tries to open more, a crank and the receptor abut, which results in locking the receptor from further rotating.

2. The automated receptor system according to claim 1, wherein the receptor comprises a hook.

3. The automated receptor system according to claim 2, wherein the hook comprises a boring for receiving an axis of rotation.

4. The automated receptor system according to claim 1, wherein the drive system comprises at least one of the following features:

a motor for driving the pivoting motion of the receptor, a crank shaft for transmitting the driving power from the motor to the receptor, a bearing for supporting the crank shaft and a crank mounted on the crank shaft for transmitting the power from the crank shaft to the receptor.

5. The automated receptor system according to claim 1, further comprising a detection system for detecting whether the connection device is in the correct position when closing the receptor.

6. The automated receptor system according to claim 1, further comprising a connecting rod for connecting a crank shaft to the receptor for pivoting the receptor from a closed position into a released position and from the released-position into the closed position.

7. The automated receptor system according to claim 1, further comprising a sensor system for detecting whether the drive system for pivoting the receptor has positioned the receptor in a closed or released position, wherein the sensor system comprises a sensor arm attached to a crank shaft and a sensor supported by a sensor mount.

8. A sling-receiving element for gripping a connection device of a sling of a blade gripping device for gripping a rotor blade of a wind turbine, which sling receiving element comprises an automated receptor system according to claim 1.

9. A blade gripping device for gripping a rotor blade of a wind turbine, which blade gripping device comprises:

a sling-receiving element according to claim 8.

10. The blade gripping device according to claim 9, further comprising: a blade gripping tool comprising:

a sling and an automatic sling handover mechanism comprising a sling-conveying element and a sling-receiving element, whereby the sling-conveying element is realized to convey a connection device of the sling along a two-dimensional predefined path of travel around a part of the rotor blade towards the sling-receiving element to connect to a receptor of the sling-receiving element.

* * * * *